US010604859B2

(12) United States Patent
Miyakawa

(10) Patent No.: US 10,604,859 B2
(45) Date of Patent: Mar. 31, 2020

(54) METHOD FOR FORMING PATTERN, METHOD FOR MANUFACTURING ORNAMENT, METHOD FOR MANUFACTURING BELT FOR WRISTWATCH, METHOD FOR MANUFACTURING STRUCTURE FOR MOUNTING WIRING, METHOD FOR MANUFACTURING SEMICONDUCTOR DEVICE, AND METHOD FOR MANUFACTURING PRINTED CIRCUIT BOARD

(71) Applicant: SEIKO EPSON CORPORATION, Tokyo (JP)

(72) Inventor: Takuya Miyakawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 14 days.

(21) Appl. No.: 15/696,732

(22) Filed: Sep. 6, 2017

(65) Prior Publication Data

US 2018/0087169 A1 Mar. 29, 2018

(30) Foreign Application Priority Data

Sep. 27, 2016 (JP) ..... 2016-187874

(51) Int. Cl.

| | |
|---|---|
| ***C25D 5/02*** | (2006.01) |
| ***B41J 2/16*** | (2006.01) |
| ***C25D 7/00*** | (2006.01) |
| ***C25D 7/12*** | (2006.01) |
| ***C25D 5/48*** | (2006.01) |

(Continued)

(52) U.S. Cl.

CPC ..... *C25D 5/022* (2013.01); *B41J 2/161* (2013.01); *B41J 2/162* (2013.01); *B41J 2/1623* (2013.01); *B41J 2/1629* (2013.01); *B41J 2/1643* (2013.01); *C25D 5/024* (2013.01); *C25D 5/48* (2013.01); *C25D 7/00* (2013.01); *C25D 7/005* (2013.01); *C25D 7/12* (2013.01); *C25D 7/123* (2013.01);

(Continued)

(58) Field of Classification Search

CPC . C25D 5/022; C25D 5/45; C25D 5/48; C25D 5/024; C25D 7/00; C25D 7/005; C25D 7/123; C25D 7/12; B41J 2/161; B41J 2/1623; B41J 2/1643; B41J 2/162; B41J 2/1629; B41J 2002/144491; G04B 37/22; G04B 37/1486

See application file for complete search history.

(56) References Cited

U.S. PATENT DOCUMENTS 6,537,719 B1 * 3/2003 Takahashi ..... C08L 61/06 430/191
2002/0195419 A1 * 12/2002 Pavelchek ..... G03F 7/091 216/16

(Continued)

FOREIGN PATENT DOCUMENTS

| | | |
|---|---|---|
| JP | 05-040182 | 2/1993 |
| JP | 2006-237088 | 9/2006 |

*Primary Examiner* — Louis J Rufo
(74) *Attorney, Agent, or Firm* — Workman Nydegger

(57) ABSTRACT

A method for forming a pattern in which a plating layer is selectively formed on a base material using a resin layer as a mask, includes resin layer-forming in which the resin layer is formed on the base material; and patterning in which the resin layer is selectively removed, in which in the patterning, a part of the resin layer is sublimed by heating to be removed.

18 Claims, 9 Drawing Sheets

(51) Int. Cl.

| | |
|---|---|
| ***G04B 37/22*** | (2006.01) |
| ***B41J 2/14*** | (2006.01) |
| ***G04B 37/14*** | (2006.01) |

(52) U.S. Cl.
CPC ..... *G04B 37/22* (2013.01); *B41J 2002/14491* (2013.01); *G04B 37/1486* (2013.01)

(56) References Cited

U.S. PATENT DOCUMENTS

| | | | | |
|---|---|---|---|---|
| 2003/0036006 | A1* | 2/2003 | Feke | G03F 7/105<br>430/30 |
| 2005/0037275 | A1* | 2/2005 | Toyoda | B41M 5/24<br>430/211 |
| 2006/0052569 | A1* | 3/2006 | Lehmann | C07F 7/1804<br>528/38 |
| 2013/0302991 | A1* | 11/2013 | Kanno | G03F 7/36<br>438/703 |
| 2017/0103924 | A1* | 4/2017 | Park | G03F 7/70625 |

* cited by examiner

| | NAPHTHALENE | ANTHRACENE | NAPHTHACENE | PENTACENE |
|---|---|---|---|---|
| BOILING POINT [°C] | 218 | 342 | 436.7 | DECOMPOSITION AT 1 ATM |
| MOLECULAR WEIGHT | 128 | 178 | 228 | 278 |
| SUBLIMATION TEMPERATURE [°C] | ROOM TEMPERATURE | 150 | 250 | UNCLEAR |
| SUITABILITY FOR RESIST | × | ○ | ○ | × |

METHOD FOR FORMING PATTERN, METHOD FOR MANUFACTURING ORNAMENT, METHOD FOR MANUFACTURING BELT FOR WRISTWATCH, METHOD FOR MANUFACTURING STRUCTURE FOR MOUNTING WIRING, METHOD FOR MANUFACTURING SEMICONDUCTOR DEVICE, AND METHOD FOR MANUFACTURING PRINTED CIRCUIT BOARD

BACKGROUND

1. Technical Field

The present invention relates to a method for forming a pattern of an ornament in which plating is selectively applied to a surface of a base material, a method for manufacturing an ornament, a method for manufacturing a belt for a wristwatch, a method for manufacturing a structure for mounting wiring, a method for manufacturing a semiconductor device, and a method for manufacturing a printed circuit board.

2. Related Art

Regarding some of ornaments such as the exterior and a belt (band) of a wristwatch, the aesthetic appearance thereof is enhanced by applying plating to a surface of a base material such as metal, for example. In addition, in electronic components such as a printed circuit board and a semiconductor device, plating is applied to form electrodes and wirings. In a case where plating is partially formed on a target base material or plating of different colors is applied to different positions, plating is generally selectively applied by using a patterned organic resist (for example, refer to JP-A-5-040182).

Since a resist used for plating is transparent in the related art, there is a problem that it is difficult to inspect the shape of a pattern, pinholes, and the like. Furthermore, there is also a problem that an organic solvent for application, removal, and the like of the resist, and equipment are required, which acts as constraints, and therefore efficient manufacturing is difficult. Furthermore, a patterning method in which the resist is removed through pyrolysis is considered, but a photosensitive resin of a relatively high polymer (for example 320 or more), and the like are generally used for a photoresist and a hand-applied resist. Therefore, there is a problem in the method in which the resist is removed through pyrolysis that sagging pattern shape of the resist occurs due to melting with heat (collapse of the shape), or carbon deposits are generated, which lead to a deterioration in a patterning accuracy. The same problems also exist in a case of forming a structure for mounting wiring, a semiconductor device, wiring for a printed circuit board, or the like by using the same method as well as in the above ornaments.

SUMMARY

An advantage of some aspects of the invention is to provide a method for forming a pattern of an ornament to which plating can be applied more efficiently without needing an organic solvent or equipment, a method for manufacturing an ornament, a method for manufacturing a belt for a wristwatch, a method for manufacturing a structure for mounting wiring, a method for manufacturing a semiconductor device, and a method for manufacturing a printed circuit board.

According to an aspect of the invention, there is provided a method for forming a pattern in which a plating layer is selectively formed on a base material using a resin layer as a mask, the method including: resin layer-forming in which the resin layer is formed on the base material; and patterning in which the resin layer is selectively removed, in which in the patterning, a part of the resin layer is sublimed by heating to be removed.

According to the aspect of the invention, since patterning and removing of the resin layer can be performed through sublimation by heating, a dedicated solvent (organic solvent) and equipment for patterning and removing of the resin layer are not necessary. Therefore, the constraints on equipment are reduced, which enables more efficient and selective applying of plating to a base material of an ornament.

In the method, it is preferable that the resin layer be partially heated by being irradiated with infrared ray in the patterning.

According to this, since the resin layer is partially heated by irradiation with the infrared ray whereby the part of the resin layer can be sublimed to be removed, it is possible to perform patterning with simpler equipment.

In the method, it is preferable that the infrared ray be a laser beam.

According to this, sagging due to heat (collapse of the patterning shape) and carbon deposits are prevented from being generated, and therefore patterning of the resin layer can be performed at a higher degree of accuracy.

In the method, it is preferable that the resin layer has fluorescence properties.

According to this, the fluorescence of the resin layer makes it easy to detect defects in the resin layer such as the collapse of the shape, pinholes, and the like, and therefore the yield rate is improved.

In the method, it is preferable that the resin layer be an acene having a molecular weight of 150 or more and 300 or less.

According to this, an acene having a molecular weight of 150 or more and 300 or less can be sublimed to be removed by irradiation with the infrared ray, and has the fluorescence properties, and thus is more suitable for the invention.

It is preferable that the method further includes adhesive layer-forming in which an adhesive layer having a $\pi$ bond which enhances the adhesion between the base material and the resin layer is formed on the base material, before the resin layer-forming.

According to this, it is possible to improve the bond strength between the resin layer and the adhesive layer and to enhance the fluorescence properties of the resin layer.

It is preferable that the method further includes plating in which the plating layer is formed on a part of the base material from which the resin has been removed, after the patterning.

According to this, it is possible to selectively form the plating layer on the base material at a higher degree of accuracy using the patterned resin layer as a mask.

It is preferable that the method further includes plating in which the plating layer is formed on the base material before the resin layer-forming; and etching in which an etching process is applied to the plating layer on the part from which the part of the resin layer has been removed, after the patterning.

According to this, it is possible to etch the plating layer on the base material at a higher degree of accuracy using the patterned resin layer as a mask.

According to another aspect of the invention, there is provided a method for manufacturing an ornament to which any one of the above methods for forming a pattern is applied.

According to still another aspect of the invention, there is provided a method for manufacturing a belt for a wristwatch to which any one of the above methods for forming a pattern is applied.

According to still further another aspect of the invention, there is provided a method for manufacturing a structure for mounting wiring to which any one of the above methods for forming a pattern is applied.

According to still further another aspect of the invention, there is provided a method for manufacturing a semiconductor device to which any one of the above methods for forming a pattern is applied.

According to still further another aspect of the invention, there is provided a method for manufacturing a printed circuit board to which any one of the above methods for forming a pattern is applied.

According to the manufacturing methods, patterning and removing of the resin layer can be performed through sublimation by heating, and thus a dedicated solvent (organic solvent) and equipment for patterning and removing of the resin layer are not necessary. Therefore, the constraints on equipment are reduced, which enables more efficient and selective applying of plating to a base material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for carrying out the invention will be described with reference to the accompanying drawings. In the embodiments described below, various restrictions are made as preferred specific examples of the invention, but the scope of the invention is not limited to these embodiments unless there is a description particularly limiting the invention. In the present embodiment, as an example of an ornament according to the invention and as a belt for a wristwatch according to the invention, belts 3 of a wristwatch 1 are exemplified and an example of formation of a plating pattern on the belts 3 will be described.

Figure 1:
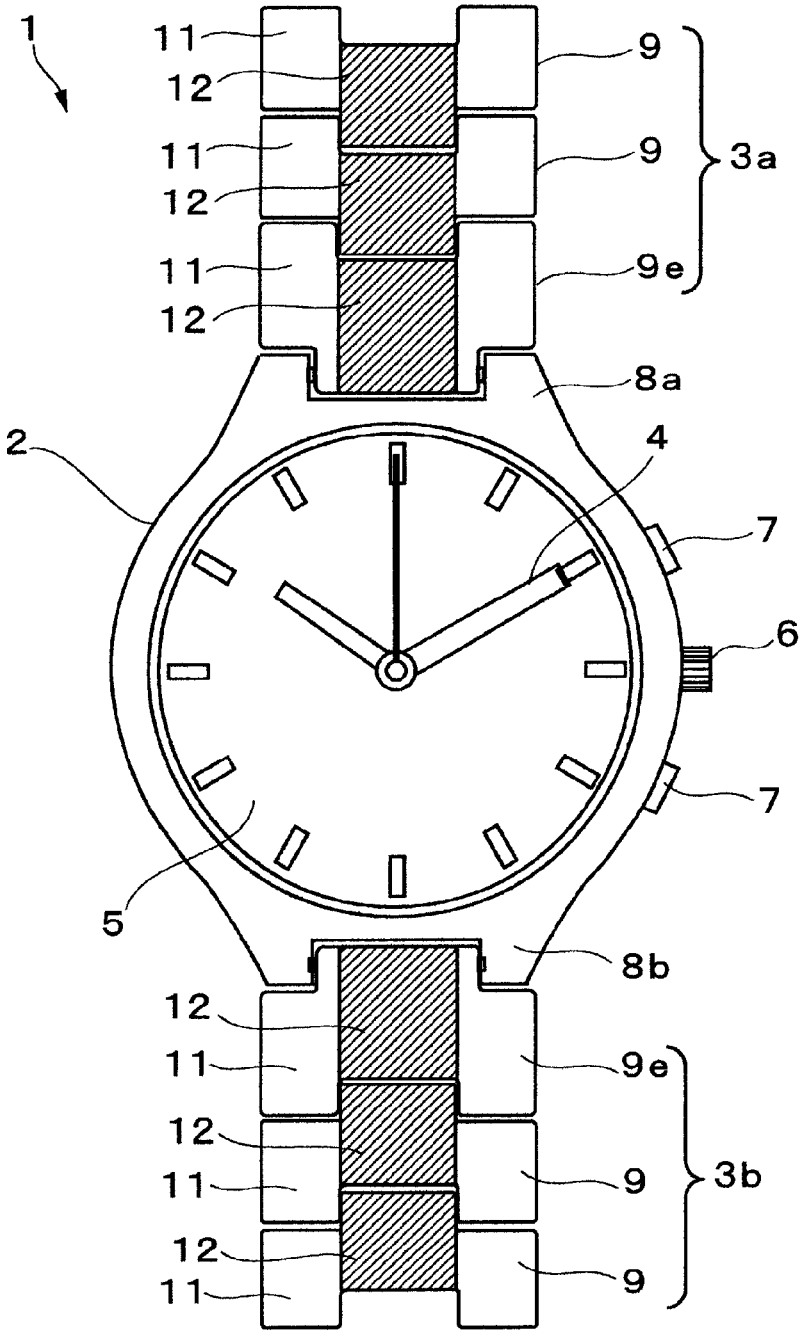
FIG. 1 is a plan view illustrating a configuration of a wristwatch.

FIG. 1 is a plan view illustrating a configuration of the wristwatch 1. The wristwatch 1 in the present embodiment includes a case 2 which is an exterior part of a watch main body and the belts (band) 3 which are a type of an ornament in the invention. The case 2 is also referred to as a "side (wrinkle)", and accommodates a needle 4, a dial face 5, a movement (not shown), and the like, and includes, on the side surface, a crown 6, an operation button 7, and the like involved in time adjustment and the like. The belts 3 are formed of a first belt 3*a* and a second belt 3*b* respectively connected to lugs (connecting parts) 8*a* and 8*b* integrally provided on the 6 o'clock side and the 12 o'clock side of the case 2. Each of the belts 3*a* and 3*b* is configured by connecting a plurality of belt pieces 9. The belts 3*a* and 3*b* will be simply referred to as the belts 3 without distinction in below. Each belt piece 9 configuring the belts 3 is connected by a pin (not shown). A belt piece 9*e* closest to the case 2 side among these belt pieces 9 is an end piece connected to the lugs 8*a* and 8*b*, respectively. Furthermore, ends on a side opposite to belt piece 9*e* of each of the belts 3*a* and 3*b* are configured to be fastenable by a buckle (clasp) not shown. The belt pieces 9 and 9*e* will be simply referred to as belt pieces 9 without distinction in below.

The belt pieces 9 in the present embodiment are made of, for example, a metal such as titanium or stainless steel. Each of the belt pieces 9 has a first part 11 made of a color of a metallic material, and a second part 12 (in the drawing, a hatched part) to which a color different from the color of the first part 11, for example, gold plating is applied. As above, plating is partially applied to the belt pieces 9 (a pattern of plating is formed), and therefore appearance feature and aesthetic appearance are imparted on the belts 3.

Figure 2:
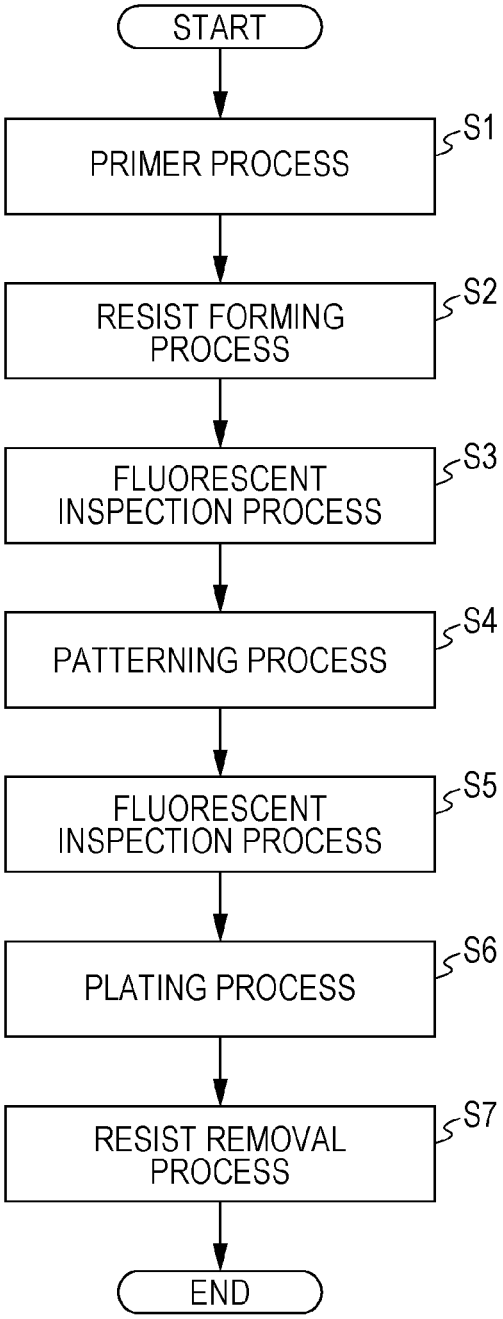
FIG. 2 is a flowchart illustrating a method for manufacturing a belt piece.
Figure 3:
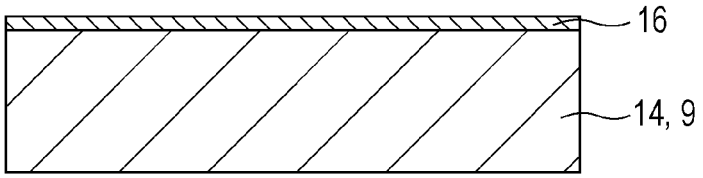
FIG. 3 is a process chart illustrating the method for manufacturing a belt piece.
Figure 4:
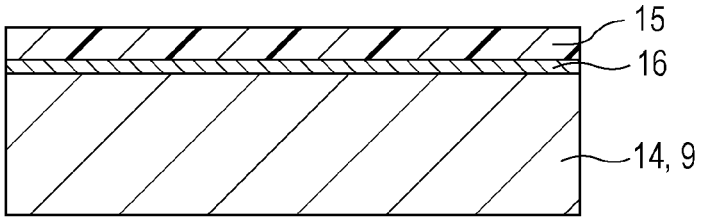
FIG. 4 is a process chart illustrating the method for manufacturing a belt piece.

FIG. 2 is a flowchart illustrating a method for manufacturing the belt pieces 9 (a process of mainly forming a plating pattern on the base material 14 of the belt pieces 9). FIGS. 3 to 8 are process charts related to a method for manufacturing the belt pieces 9. First, as shown in FIG. 3, a primer layer 16 (corresponding to an adhesive layer in the invention) is formed on a surface to which plating is applied (first surface) on the base material 14 of the belt pieces 9 (primer process S1/corresponding to an adhesive layer forming process in the invention). As a primer, a silane coupling agent capable of enhancing the fluorescence of a resist layer 15 by bonding with the resist layer 15 as well as capable of enhancing the adhesion between the resist layer 15 and the base material 14, is used. Details of this primer will be described later. If the primer layer 16 is formed on the base material 14, subsequently, the resist layer 15 (corresponding to a resin layer in the invention) is formed on the first surface on which the primer layer 16 of the base material 14 is formed by vapor deposition (resist forming process S2/corresponding to a resin layer forming process in the invention) as shown in FIG. 4. As a material of the resist layer 15, a synthetic resin that is sublimed by heating in a vacuum or at an atmospheric pressure (1 atm) in a patterning process to be described later, and that has the fluorescence properties is used.

Figures 9, 10:
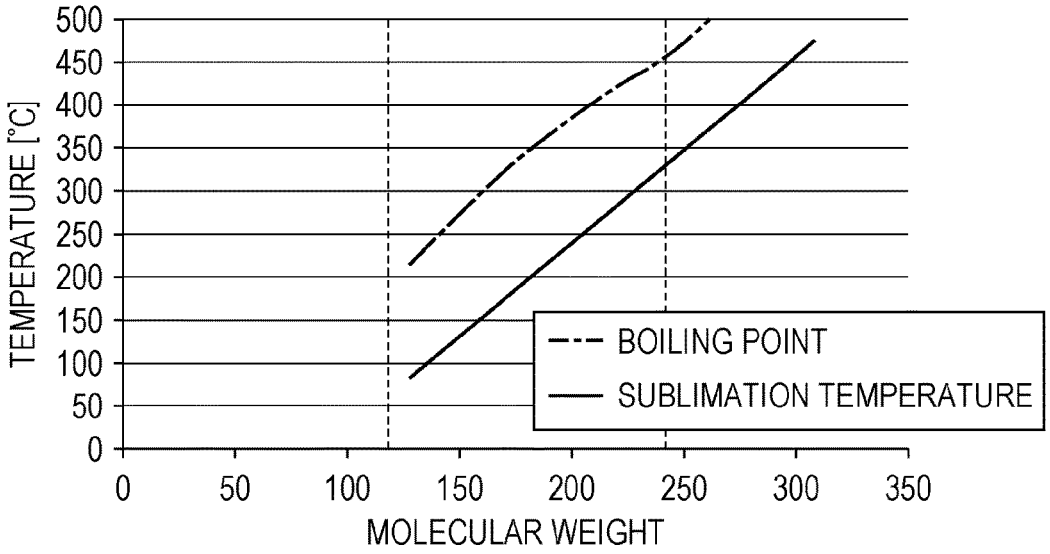
FIG. 9 is a table showing a boiling point, a molecular weight, a sublimation temperature, and suitability as a material for a resist layer of acenes.
FIG. 10 is a graph showing the relationship between the molecular weight, and the boiling point and the sublimation temperature of the acenes.

FIG. 9 is a table showing a boiling point (° C.) at 1 atm, a molecular weight, a sublimation temperature (° C.) in a vacuum, and suitability as the material of the resist layer 15 of acenes that are candidates for the material of the resist layer 15. In the drawing, a case where an acene is suitable as the material of the resist layer 15 is indicated by O, and a case where an acene is unsuitable as the material of the resist layer 15 is indicated by X. FIG. 10 is a graph showing the relationship between the molecular weight, and the boiling point (° C.) and the sublimation temperature (° C.) of the acenes. The manufacturing method according to the invention has characteristics that patterning is performed by partially heating the resist layer 15 and then removing the corresponding part of the resist layer through pyrolysis (patterning without using a photolithography method), and that inspection on the film formation is performed by allowing the fluorescence of the resist layer 15 by being irradiated with light (ultraviolet rays). Among these, in order to satisfy the former requirement as the material of the resist layer 15, a condition is to perform sublimation by heating with a relatively low molecular weight. Examples of a resist material having a relatively low molecular weight (molecular weight of 300 or less) include compounds such as anthracene, naphthacene (tetracene), pyrene, pentacene, adamantane, biadamantane, diamantine, and the like. Among these, those that have the fluorescence properties which is the requirement of the latter as the material of the resist layer 15 are acenes such as anthracene, naphthacene, pyrene and pentacene.

As shown in FIG. 9, although naphthalene is an acene, naphthalene is sublimed at room temperature and thus is unsuitable as the material of the resist layer 15 (X). Pentacene is decomposed at 1 atm, and thus is also unsuitable as the material of the resist layer 15 (X). Among the acenes in FIG. 9, anthracene and naphthacene are suitable as the material of the resist layer 15 from the viewpoint that anthracene and naphthacene can be sublimed by heating by irradiation with the infrared rays and have the fluorescence properties, for example (O). Regarding the relationship between the molecular weight of these acenes, and the boiling point and the sublimation temperature, the molecular weight, and the boiling point and the sublimation temperature is in a proportional relationship as shown in FIG. 10. Considering the sublimation from heat generated by infrared absorption, the molecular weight of the acenes suitable as the material of the resist layer 15 is 150 or more and 300 or less. If the temperature is 300° C. or higher, both titanium and stainless steel, which are the materials of the base material 14 in the present embodiment, are discolored. Therefore, it is preferable to perform the sublimation at a temperature lower than 300° C. Considering the above, it is more preferable that the molecular weight of the acenes suitable as the material of the resist layer 15 be 150 or more and 225 or less.

Next, in a case where the acenes are used as the material of the resist layer 15, the primer layer 16 that has a π bond is preferable. By sharing more n electrons with the material of the resist layer 15, the bond strength between the material of the resist layer 15 and the primer layer 16 is improved and electron transition is more likely to occur by the irradiation with light, and thus it is possible to enhance the fluorescence properties. Considering the above, examples of the material of the primer layer 16 suitable for the case where the acenes are used as the material of the resist layer 15 include phenyltrimethoxysilane and vinyltrimethoxysilane. In a case where adamantane, biadamantane, or diamantane is used as the material of the resist layer 15 without the inspection by fluorescence, examples of the material of the primer layer 16 include alkyltrimethoxysilane and cyclohexyltrimethoxysilane.

If the resist layer 15 is formed in the resist forming process, subsequently, the resist layer 15 is irradiated with the ultraviolet rays, which leads to the fluorescence of the resist layer 15, whereby the inspection on the resist layer 15 is performed (fluorescent inspection process S3). Specifically, the surface of the resist layer 15 is irradiated with light of black light as an ultraviolet ray irradiator, which leads to the fluorescence of the resist layer 15, whereby the inspection on the shape, the presence of pinholes, and the like of the resist layer 15 is performed based on the shape and brightness of a light-emitting portion. As above, the fluorescence of the resist layer 15 excited by the irradiation with the ultraviolet rays, makes it easy to detect defects in the resist such as the collapse of the shape, pinholes, and the like, which are difficult to detect in a transparent resist of the related art, and therefore the yield rate is improved. In the present embodiment, since the primer layer 16 has the π bond, by which the resist layer 15 is more likely to emit light in the fluorescent inspection process, a detection accuracy of the defects is further enhanced. As the ultraviolet ray irradiator, it is possible to adopt an LED that emits light of a specific wavelength capable of causing the resist layer 15 to emit light. In short, as long as the irradiator can cause the resist layer 15 to emit light, any irradiator may be used.

Figure 5:
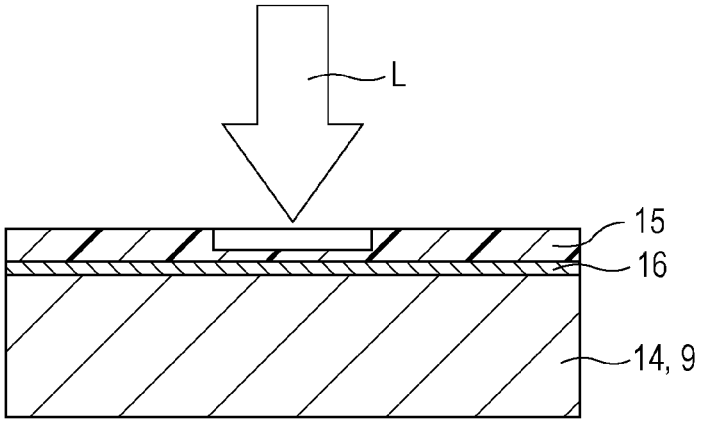
FIG. 5 is a process chart illustrating the method for manufacturing a belt piece.
Figure 6:
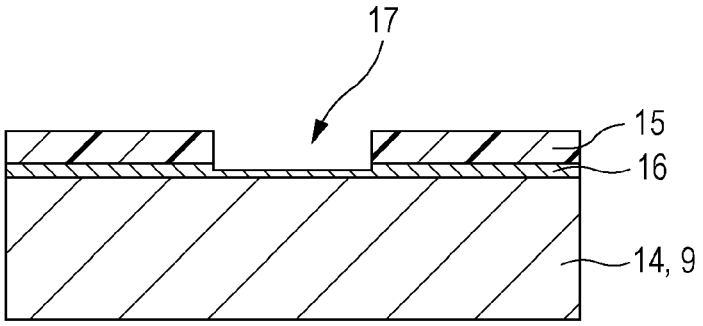
FIG. 6 is a process chart illustrating the method for manufacturing a belt piece.

In the fluorescent inspection process S3, if it is determined that the resist layer 15 is formed normally (no defect is found), subsequently, the patterning of the resist layer 15 is performed as shown in FIGS. 5 and 6 (patterning process S4). In this patterning process, the resist layer 15 is partially heated, the heated part of the resist layer 15 is selectively sublimed to be removed, and therefore a predetermined shape is patterned. More specifically, by irradiating a part corresponding to the second part 12 of the resist layer 15 with the infrared rays of an absorption wavelength of the resist layer 15, the corresponding part of the resist layer 15 is heated and sublimed to be removed. As an infrared ray irradiator, a laser beam L is used as shown in FIG. 5. By locally heating the resist layer 15 by the irradiation with the laser beam L so that the resist layer 15 is sublimed to be removed, sagging due to heat (collapse of the patterning shape), ablation (breakage of the resist layer 15 in an unintended part), and the carbon deposits are prevented from being generated, and therefore it is possible to perform the patterning of the resist layer 15 at a higher degree of accuracy. Furthermore, by partially heating the resist layer 15 by the irradiation with the infrared rays, the sublimation and the removal of the corresponding part of the resin layer become possible, and therefore the patterning can be performed with simpler equipment. Hereinafter, the part from which the resist layer 15 is removed in the patterning process (the part corresponding to the second part 12) will be referred to as a removal part 17.

Figure 7:
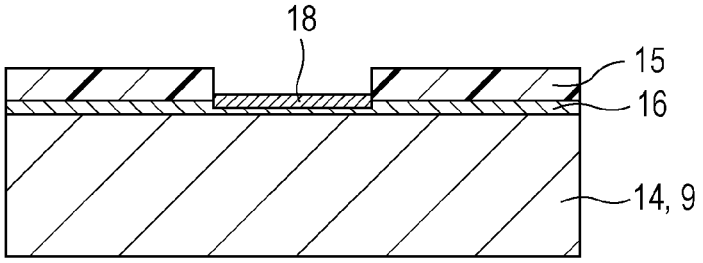
FIG. 7 is a process chart illustrating the method for manufacturing a belt piece.
Figure 8:
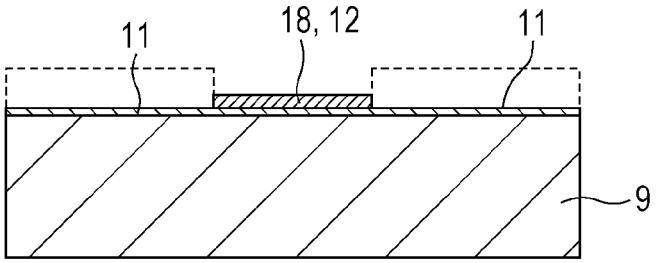
FIG. 8 is a process chart illustrating the method for manufacturing a belt piece.

If the resist layer 15 is patterned, the inspection on the resist layer 15 after the patterning is performed by allowing the fluorescence of the resist layer 15 again (fluorescent inspection process S5). That is, similarly to the fluorescent inspection process S3, the surface of the resist layer 15 is irradiated with light of black light as the ultraviolet ray irradiator, which leads to the fluorescence of the resist layer 15, whereby the inspection on the shape, the presence of pinholes, and the like of the resist layer 15 after patterning is performed based on the shape and brightness of a light-emitting portion. In the fluorescent inspection process S5, in a case where it is determined that the resist layer 15 after patterning is normal, subsequently, a plating layer 18 is subsequently formed on the base material 14 by, for example, an electroplating method using the resist layer 15 as a mask (plating process S6/corresponding to a plating process in the invention). In the present embodiment, the plating layer 18 made of gold (Au) is formed on the removal part 17 in the base material 14 as shown in FIG. 7. If the plating layer 18 is formed, subsequently, the resist layer 15 after patterning is heated so that the resist layer 15 is sublimed to be removed as shown in FIG. 8 (resist removal process S7). At this time, the entire base material 14 is heated at 200° C. to remove the resist layer 15, for example.

As described above, the belt pieces 9 in which plating is selectively applied to the second part 12 (plating layer 18) are manufactured. According to the invention, since patterning and removing of the resist layer 15 can be performed through the sublimation by heating, a dedicated solvent for removing the resist and a developer for patterning the resist are not necessary. Therefore, the constraints on equipment are reduced, which enables more efficient applying of plating to an ornament such as the belts 3 in the present embodiment, and the like. In addition, it is possible to detect the defects in the resist such as the collapse of the shape, pinholes, and the like by using the fluorescence, which enables more efficient and selective plating at a higher degree of accuracy. As a result, the yield rate is improved.

Figure 11:
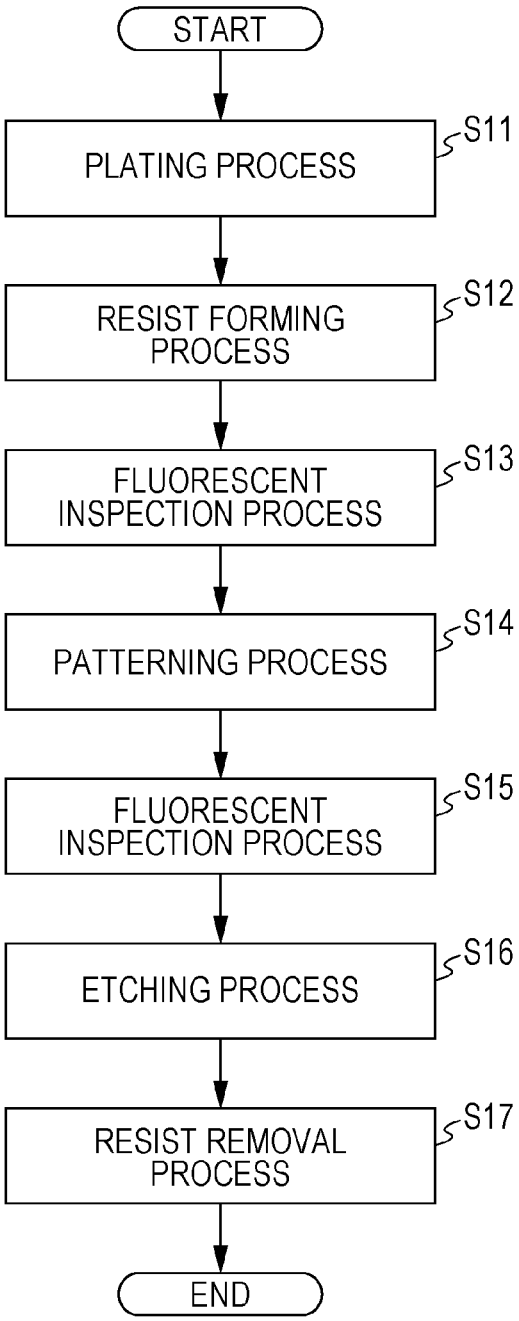
FIG. 11 is a flowchart illustrating a method for manufacturing a belt piece according to a second embodiment.
Figure 12:
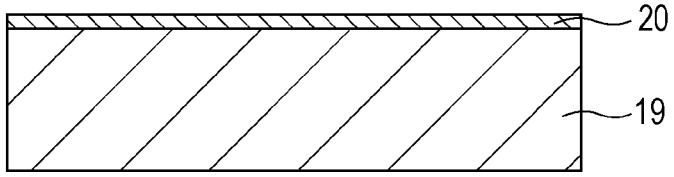
FIG. 12 is a process chart illustrating the method for manufacturing a belt piece according to the second embodiment.
Figure 13:
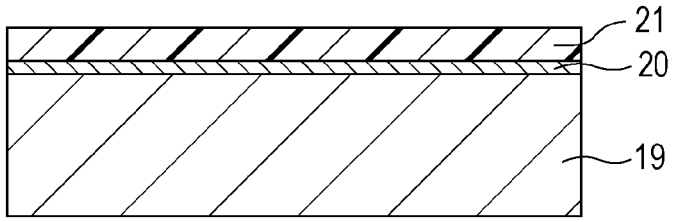
FIG. 13 is a process chart illustrating the method for manufacturing a belt piece according to the second embodiment.
Figure 14:
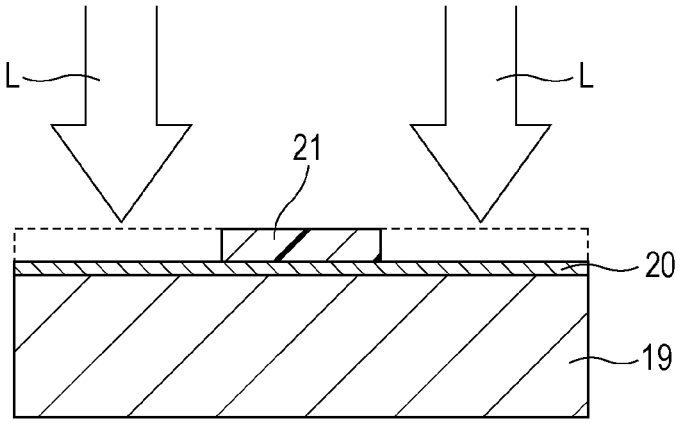
FIG. 14 is a process chart illustrating the method for manufacturing a belt piece according to the second embodiment.
Figure 15:
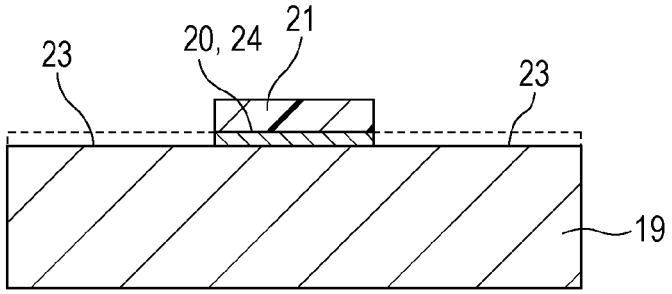
FIG. 15 is a process chart illustrating the method for manufacturing a belt piece according to the second embodiment.
Figure 16:
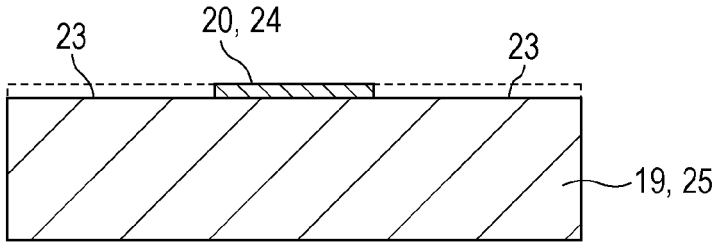
FIG. 16 is a process chart illustrating the method for manufacturing a belt piece according to the second embodiment.

FIG. 11 is a flowchart illustrating a manufacturing process of belt pieces 25 according to a second embodiment in the invention. In addition, FIGS. 12 to 16 are process charts illustrating the manufacturing process of the belt pieces 25 according to the second embodiment. In the first embodiment, the manufacturing method in which plating is selectively applied to the base material 14 by using the resist layer 15 as a mask is exemplified, but the invention is not limited thereto. In the present embodiment, first, as shown in FIG. 12, a plating layer 20 is formed on the entire surface of a base material 19 (plating process S11/corresponding to the plating process in the invention). As a method for forming the plating layer 20, an electroplating method, an electroless plating method, a CVD method, a sputtering method, a vapor deposition method, an ion plating method, or the like can be adopted. Subsequently, as shown in FIG. 13, a resist layer 21 (corresponding to the resin layer in the invention) is formed on the plating layer 20 (resist forming process S12/corresponding to the resin layer forming process in the invention). Although omitted in the present embodiment, a primer process may be performed between the plating process S11 and the resist forming process S12 in the same manner as in the first embodiment. If the resist layer 21 is formed, subsequently, the resist layer 21 after forming is irradiated with the ultraviolet rays, which leads to the fluorescence of the resist layer, whereby the inspection on the shape of the resist layer 21, and the like is performed (fluorescent inspection process S13). If there is no problem in the fluorescent inspection process S13, as shown in FIG. 14, the resist layer 21 is partially sublimed to be removed by the irradiation with a laser beam, and therefore is patterned (patterning process S14). In the present embodiment, by irradiating a part corresponding to a first part 23 made of the color of the base material 19 with the laser beam L, the corresponding part of the resist layer 21 is sublimed to be removed. Subsequently, by the fluorescence excited by irradiating the resist layer 21 after patterning with the ultraviolet rays, the inspection on the shape of the resist layer 21 after patterning, and the like is performed (fluorescent inspection process S15). If there is no problem in the fluorescent inspection process S15, as shown in FIG. 15, the plating layer 20 in a part corresponding to the first part 23 is removed by etching using the resist layer 21 after patterning as a mask (etching process S16/corresponding to an etching process in the invention). Subsequently, the resist layer 21 after patterning is heated so that the resist layer 21 is sublimed to be removed as shown in FIG. 16 (resist removal process S17).

As described above, the belt pieces 25 in which plating is selectively applied to a second part 24 (plating layer 20) are manufactured. In the present embodiment, since patterning and removing of the resist layer 21 can be performed through the sublimation by heating in the same manner as in the first embodiment, a dedicated solvent for removing the resist and a developer for patterning are not necessary. Therefore, the constraints on equipment are reduced, which enables more efficient applying of plating. In addition, it is possible to detect the defects in the resist such as the collapse of the shape, pinholes, and the like by using the fluorescence, which enables more efficient and selective plating at a higher degree of accuracy. As a result, the yield rate is improved. By combining the manufacturing method of the first embodiment and the manufacturing method of the second embodiment, for example, it is also possible to apply plating of different colors to different positions of the base material.

As an example of the method for forming a pattern, the method for manufacturing an ornament, or the method for manufacturing a belt for a wristwatch according to the invention, the case of selectively applying plating to the belt pieces 9 of the belts 3 in the wristwatch 1 has been exemplified in the above description, but the invention is not limited thereto and is also applicable to various ornaments. Furthermore, the invention is not limited to plating on the surface of a metal such as stainless steel, and can also be applied to plating on resin products, for example. The invention is not limited to the ornament and can also be applied to a method for manufacturing a structure for mounting wiring or a semiconductor device, in which driving elements such as piezoelectric elements, driving ICs, electrodes, wirings, and the like are mounted on a silicon substrate, such as an ink jet recording head (a type of liquid ejecting head) exemplified below, and additionally, to a method for manufacturing a printed circuit board on which electronic devices, wirings, and the like are mounted, and particularly to applications where wiring is formed by plating.

Figure 17:
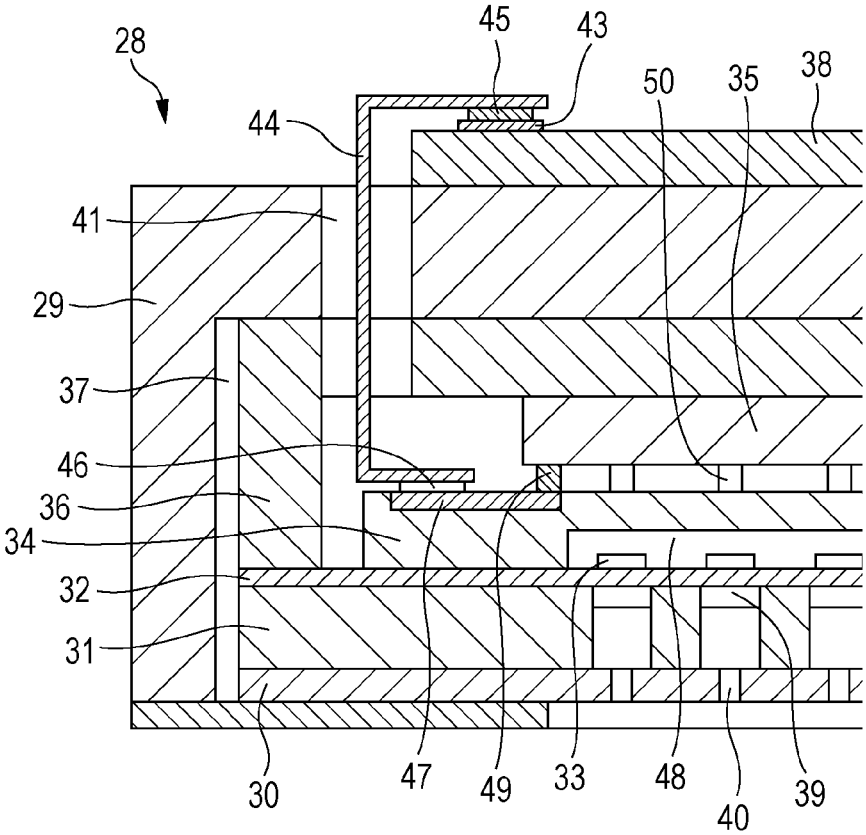
FIG. 17 is a cross-sectional view illustrating a configuration of a recording head (a structure for mounting wiring, a semiconductor device, and a printed circuit board) according to a third embodiment.

FIG. 17 is a cross-sectional view illustrating an ink jet recording head 28 (hereinafter will be referred to as the recording head) which is an aspect of a structure for mounting wiring or a semiconductor device according to a third embodiment in the invention. The recording head 28 in the present embodiment is configured by being attached to a head case 29 in which a plurality of substrates and the like are laminated. In each substrate, a nozzle plate 30, a flow-channel forming substrate 31, and a diaphragm 32 are laminated in this order and bonded to each other by an adhesive or the like to form a unit. Furthermore, a piezoelectric element 33 (a type of driving element), a sealing plate 34, and a driving IC 35 are laminated on the upper surface (the surface opposite to the flow-channel forming substrate 31 side) of the diaphragm 32. These laminated bodies are fixed to a holder 36 and are accommodated and fixed in an accommodation space 37 of the head case 29. A circuit board 38 (a form of a printed circuit board) is disposed on the upper surface on the side opposite to the accommodation space 37 of the head case 29. The flow-channel forming substrate 31 is a substrate in which a liquid flow channel such as a pressure chamber 39 communicating with a nozzle plate 30 is formed, and is made of a silicon substrate, for example. An ink is supplied to the pressure chamber 39 from an ink storage member such as an ink cartridge not shown. An opening surface on the side opposite to the nozzle plate 30 of the pressure chamber 39 is sealed with the flexible diaphragm 32, and in this part, the piezoelectric element 33 in which a lower electrode layer, a piezoelectric layer, and an upper electrode layer are sequentially laminated is formed. If an electric field in accordance with a potential difference between the lower electrode layer and the upper electrode layer is applied to both electrodes, the piezoelectric element 33 flexurally deforms in a direction away from or close to a nozzle 40. As a result, pressure fluctuation occurs in the ink inside the pressure chamber 39, and by controlling the pressure fluctuation, the ink is ejected from the nozzle 40.

The circuit board 38 disposed on the upper surface of the head case 29 is a printed circuit board on which a wiring pattern and the like are formed for supplying a driving signal and ejection data and the like from a printer main body side to the piezoelectric element 33. On the upper surface of the circuit board 38, a plurality of circuit board terminals 43 are arranged side by side, and a connector (not shown) to which an FFC 5 from the printer main body side is connected, other electronic components, wiring, and the like are mounted. In the head case 29, a wiring insertion port 41 communicating with the accommodation space 37 is formed. A flexible board 44 having one end side terminal 45 electrically connected to the circuit board terminals 43 of the circuit board 38 is inserted through the wiring insertion port 41. The other end side terminal 46 of the flexible board 44 is electrically connected to a board electrode terminal 47 formed on the upper surface (mounting surface) of the sealing plate 34.

The sealing plate 34 in the present embodiment is a plate material that functions as a protective substrate for protecting the piezoelectric element 33 and also functions as a so-called interposer. The sealing plate 34 is disposed in a state where a space 48 for accommodating the piezoelectric element 33 is formed between the sealing plate 34 and the diaphragm 32. On the upper surface side of the sealing plate 34, the driving IC 35 for outputting the driving signal for driving the piezoelectric element 33 is disposed. The sealing plate 34 has a flow-through electrode (not shown) penetrating in a thickness direction, and an output terminal 50 of the driving IC 35 and the element electrode terminal (not shown) of each piezoelectric element 33 are brought into conduction through the flow-through electrode. The driving signal from the control circuit, the ejection data (raster data), and the like are input to the driving IC 35 via the flexible board 44, whereby the driving IC 35 performs the selection control of driving pulses to be output to each piezoelectric element 33 from the driving signal based on the ejection data. On the lower surface (surface on the sealing plate 34 side) of the driving IC 35, an input terminal 49 to which the driving signal from the flexible board 44, and the like are input, and the output terminal 50 provided in accordance with each piezoelectric element 33, are provided.

The board electrode terminal 47 connected to the input terminal 49 of the driving IC 35 and also connected to the one end side terminal 45 of the flexible board 44 is formed on the upper surface (mounting surface) of the sealing plate 34. Each board electrode terminal 47 extends in a longitudinal direction of the sealing plate 34 from a position facing the input terminal 49 of the driving IC 35 on the upper surface of the sealing plate 34 to a region where the one end side terminal 45 of the flexible board 44 is connected. In the present embodiment, the driving signal is selectively applied from the driving IC 35 to the piezoelectric element 33 in accordance with the driving signal and the ejection data input to the driving IC 35 from the circuit board 38 via the flexible board 44. As a result, the piezoelectric element 33 is driven, which leads to the pressure fluctuation in the pressure chamber 39, and by controlling this pressure fluctuation, ink droplets are ejected from the nozzle 40. In such a configuration, invention can be applied to a case of forming the wiring and the circuit board terminals 43 mounted on the circuit board 38, the board electrode terminals 47 and the flow-through electrode in the sealing plate 34, or the wiring from the board electrode terminals 47 reaching to the driving IC 35, the sealing plate 34, and the piezoelectric element 33, and the like. That is, the invention can be applied to a configuration in the first embodiment and the second embodiment in which the plating layer is patterned as a wiring and an electrode. Also in this case, since patterning and removing of the resist layer when forming these wires and the like can be performed through the sublimation by heating, a dedicated solvent for removing the resist and a developer for patterning are not necessary. Therefore, the constraints on equipment are reduced, which enables more efficient forming of the wiring and the like. In addition, it is possible to detect the defects in the resist such as the collapse of the shape, pinholes, and the like by using the fluorescence, which enables more efficient forming of the wiring and the like at a higher degree of accuracy.

In the above embodiment, the ink jet recording head (liquid ejecting head) mounted on an ink jet printer has been exemplified as one aspect of a structure for mounting wiring or a semiconductor device, but the invention is also applicable to a head that ejects a liquid other than the ink. For example, the invention is also applicable to a color material-ejecting head used for manufacturing a color filter such as a liquid crystal display, an electrode material-ejecting head used for forming an electrode of an organic EL (electro luminescence) display, a FED (surface emitting display), and the like, a bioorganic substance-ejecting head used for manufacturing a biochip (biochemical element), and the like.

The entire disclosure of Japanese Patent application No. 2016-187874, filed Sep. 27, 2016 is expressly incorporated by reference herein.

What is claimed is:

1. A method for forming a pattern in which a plating layer is selectively formed on a base material using a resin layer as a mask, the method comprising:

forming a primer layer on the base material;

forming the resin layer on the primer layer;

patterning the resin layer by selectively removing a part by of the resin layer, wherein the part of the resin layer is sublimed by heating to be removed; and inspecting the patterned resin layer based on a fluorescence of the patterned resin layer, wherein the primer layer includes a π bond (pi bond);

wherein the resin layer comprises at least one of anthracene or naphthacene; and wherein the primer layer comprises at least one of phenyltrimethoxysilane or vinyltrimethoxysilane.

2. The method for forming a pattern according to claim 1, further comprising partially heating the resin layer with an infrared ray to pattern the resin layer.

3. The method for forming a pattern according to claim 2, wherein the infrared ray is a laser beam.

4. The method for forming a pattern according to claim 1, wherein the resin layer is configured to fluoresce when irradiated with an inspection irradiation.

5. The method for forming a pattern according to claim 4, wherein the resin layer is an acene having a molecular weight of 150 or more and 300 or less.

6. The method for forming a pattern according to claim 5, further comprising:

wherein the primer layer having a π bond enhances an adhesion between the base material and the resin layer on the base material, before forming the resin layer.

7. The method for forming a pattern according to claim 1, further comprising:

plating a part of the base material from which the resin has been removed to form the plating layer, after the resin layer.

8. A method for manufacturing an ornament to which the method for forming a pattern according to claim 1 is applied.

9. A method for manufacturing an ornament to which the method for forming a pattern according to claim 2 is applied.

10. A method for manufacturing an ornament to which the method for forming a pattern according to claim 3 is applied.

11. A method for manufacturing an ornament to which the method for forming a pattern according to claim 4 is applied.

12. A method for manufacturing an ornament to which the method for forming a pattern according to claim 5 is applied.

13. A method for manufacturing an ornament to which the method for forming a pattern according to claim 6 is applied.

14. A method for manufacturing an ornament to which the method for forming a pattern according to claim 7 is applied.

15. A method for manufacturing a belt for a wristwatch to which the method for forming a pattern according to claim 1 is applied.

16. A method for manufacturing a structure for mounting wiring to which the method for forming a pattern according to claim 1 is applied.

17. A method for manufacturing a semiconductor device to which the method for forming a pattern according to claim 1 is applied.

18. A method for manufacturing a printed circuit board to which the method for forming a pattern according to claim 1 is applied.

* * * * *